United States Patent [19]

Harris et al.

[11] Patent Number: 4,733,636

[45] Date of Patent: Mar. 29, 1988

[54] SURFACE TENSION BOILER

[76] Inventors: William B. Harris; Richard R. Davison, both of Texas A&M University Chemical Engineering Dept., College Station, Tex. 77843

[21] Appl. No.: 927,964

[22] Filed: Nov. 7, 1986

[51] Int. Cl.[4] ..... F22B 27/00

[52] U.S. Cl. ..... 122/39; 123/523; 165/181

[58] Field of Search ..... 123/523, 524, 557; 165/181; 122/39, 4 R

[56] References Cited

U.S. PATENT DOCUMENTS

| | | | |
|---|---|---|---|
| 1,654,551 | 1/1928 | Muhleisen | 122/39 |
| 3,175,962 | 3/1965 | Holtslag | 122/39 X |
| 3,195,627 | 7/1965 | Goodloe | 165/181 |
| 4,476,840 | 10/1984 | Budnicki et al. | 123/523 X |

*Primary Examiner*—Edward G. Favors

[57] ABSTRACT

A vaporizer for vaporizing liquid fuels having improved heat transfer and controls for vaporization of liquid fuels in response to varying degrees of fuel vapor demand and temperature requirements having a heat exchanger formed from multiple chambers having opposing surfaces composed of inert material at least at said surfaces with small but effective passages formed therebetween and the opposing surfaces being in small but effective passage relationship for sufficient length for the surface tension between a liquid fuel and the opposing surfaces of said multiple chambers to spread the liquid fuel over the opposing surfaces of the multiple chambers for maintaining said liquid fuel in relatively constant and thin liquid relationship to the opposing surfaces of the multiple chambers of the heat exchanger until the liquid fuel is vaporized; a delivery system for delivering liquid fuel to the heat exchanger; a heat delivery system for delivering heat and a heat exchanger for vaporizing the liquid fuel therein and controls for the flow of vaporized liquid fuel from the vaporizer and controls for flowing of the liquid fuel to the heat exchanger.

29 Claims, 6 Drawing Figures

SURFACE TENSION BOILER

BACKGROUND OF THE INVENTION

This invention relates to an improved vaporizer for vaporizing liquid fuels to produce dry vapor in a single pass and low liquid volume having improved heat transfer and controls for the vaporization of liquid fuels in response to varying degrees of fuel vapor demand and temperature requirements.

The prior art vaporizers have all been of a relatively large size and designed so that their application was limited by their use being compatible with design rather than their design being adapted to be compatible with the existing design of a vehicle or other existing application.

The prior art vaporizers which were small and easily adapted for mounting on vehicles tended to operate at a super heated temperature and relatively higher pressure to ensure complete vaporization of the liquid to be vaporized. Also, some prior art vaporizers developed dams at the exit of the vaporizer to prevent liquids from coming through such as in U.S. Pat. No. 3,990,432.

Further, prior art also provided super heated passages outside the ports of the vaporizer to further insure vaporization would be complete or that condensation would not occur upon reaching the colder parts of the system.

Also, prior art vaporizers were not easily and readily adaptable for adding to existing vehicles without great expense in modifying the vehicle.

Many of the prior art vaporizers attempted to heat large quantities of the fuel to be vaporized either by preheating or by having large quantities of fuel heated and ready for vaporization. Having large quantities of fuel present made the vaporization process very slow in starting up the vaporizer. In vehicles this approach was extremely undesirable.

Also, with large quantities of fuel present, the problem of over pressuring the system was great. Operating at higher pressures was dangerous because the pressures could rapidly exceed the safe level of the vaporizers.

Also, such art as U.S. Pat. No. 3,508,606 issued to Blanchard provide teachings that channels are needed for the controlled distribution of fluids both to and from the previous body, but fails to teach the critical effective size of passage relationships, and clearly does not recognize the importance of providing inert surfaces in the system.

Also, prior art systems have been provided with carbon build-up, and over a period of time become so carboned up that the whole system is blackened and closed off.

Many prior art patents have addressed the increase use of wire and other materials to increase the surface area of the heat exchanger, as in U.S. Pat. No. 3,195,627 issued to Goodloe, but none of the prior art patents or devices relate to the relationship of critical space between these materials nor have they related to the surface tension of the media being used.

OBJECTS OF THE INVENTION

This invention is designed to provide a vaporizer which can easily be mounted on a vehicle and does not require a large space for its installation.

The vaporizer of this invention is designed to minimize super heating of the vapor being vaporized.

Further, this vaporizer is designed to empty the vaporizer if excess pressure is generated, thus preventing over pressuring the system and maintaining a relatively constant pressure.

It is an object of this invention to provide the maximum heat transfer possible by having only very thin films of the liquid exposed to the heated surfaces and thus, eliminating the poor heat transfers from having a mixture of vaporized liquid and liquid in contact with the heated surfaces.

It is also the object of this invention to produce dry, slightly super heated vapor with a single pass.

It is also an object of this invention to prevent the perculator effect which would cause liquid to be slugged through vaporizer delivering liquid which would not be vaporized to the vapor regulator.

It is the further object of this invention to control the disbribution of the fluid through the vaporizer by using critical, effective size passage relationships and the surface tension of the liquid therebetween.

Yet another object of this invention is to provide inert surfaces in the system to prevent carbon formation in the vaporizer which will build-up and block or close off the system over a period of time.

It is also an object of this invention to provide the critical space relationship between the material in the vaporizer for allowing the surface tension of the media to be used in spreading the media over the material.

Yet further objects of this invention will become apparent from the description which follows.

DETAILED SPECIFICATIONS

Figure 1:
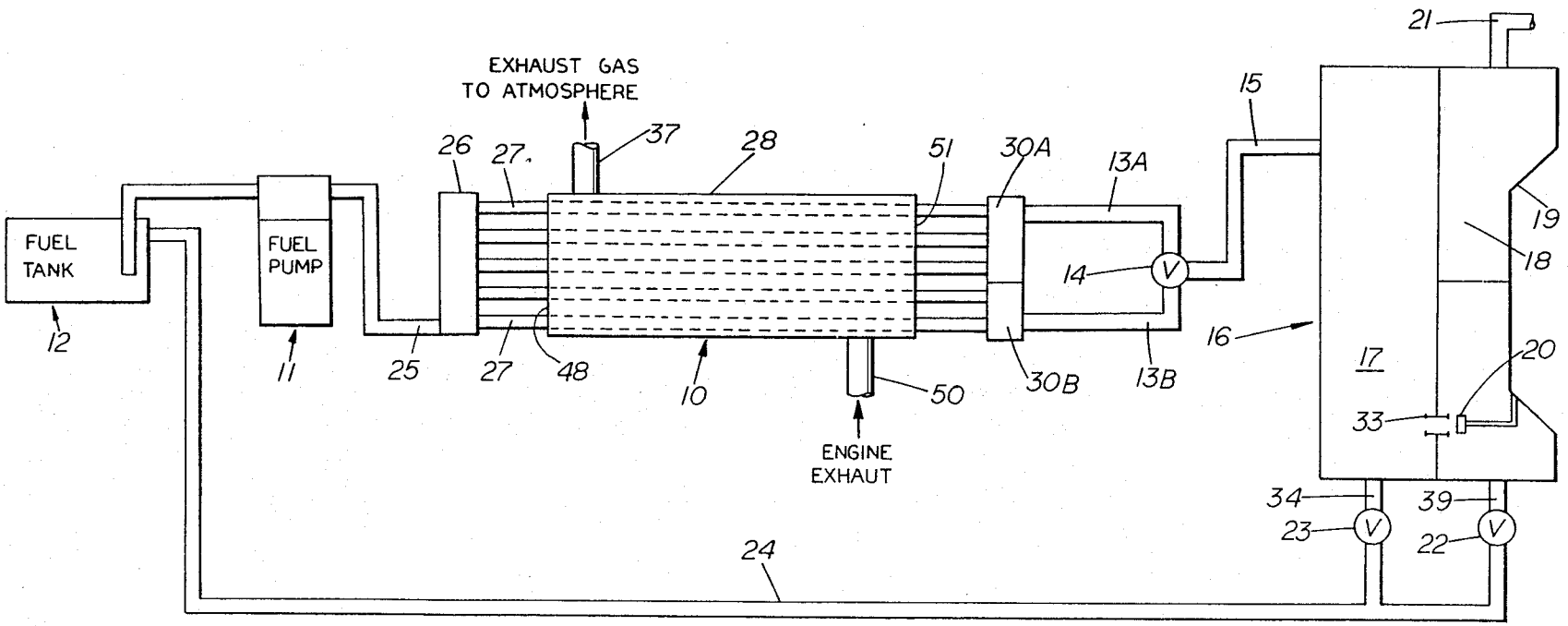
FIG. 1 is a diagramatic drawing of the fuel vaporizer of the invention.

Referring now to the drawings of FIG. 1 which show a complete vaporizer fuel system which has as its central feature a liquid fuel vaporizer 10 which is connected in fluid communication at its lowest point to a fuel pump 11, which is connected in fluid communication to a fuel tank 12 for the storage of liquid fuel. The liquid fuel vaporizer 10 is further connected in fluid communication on its other end by discharge pipe 13. In one embodiment at least two vapor discharge pipes 13A and 13B are used but they are joined at a common point wherein a multiport valve 14 discharges into a flow way 15 for flowing the vaporized fuel to a vapor regulator 16.

The vapor regulator 16 of this embodiment is a two chamber type having a high pressure chamber 17 for receiving the discharge from the flow way 15 and a low pressure chamber 18 which by way of a diaphragm sensor 19 is functionally connected to valve 20. This functional connection to valve 20 allows the low pressure chamber 18 to open to fluid communication with the high pressure chamber 17 upon varying conditions of demand because high demand creates a low pressure to open the valve 20. A discharge port 21 connected to low pressure chamber 18 is also connected in fluid communication with a carburetor, not shown, for driving the engine which is also not shown.

The vapor regulator 16 has provided, at the lowest point in the low pressure chamber 18 and the high pressure chamber 17, the valve 22 and 23 to allow the discharge of liquid fuel which may have condensed from the vaporized fuel in the respective chambers. Connected to the valves 22 and 23 is a fuel return line 24 which returns the fuel to the fuel tank 12.

The liquid fuel vaporizer 10 as shown in FIG. 1 in this embodiment shows a liquid fuel inlet 25 in fluid communication with the fuel pump 11 which supplies fuel at a relatively constant pressure and will not generally continue to pump fuel beyond a pre-determined pressure of about 7 to 8 P.S.I. The liquid fuel inlet 25 is connected to a first vaporizer manifold 26 at the lowest point in the first vaporizer manifold 26 and the vaporizer manifold 26 is further ocnnected to a series of multiple chambers 27. Liquid fuel is thus delivered at ambient temperature by the fuel pump 11 to the first vaporizer manifold 26 to establish an even and constant pressure at ambient temperature in the first vaporizer manifold 26. The first vaporizer manifold 26 is connected to multiple chambers 27 which form a heat exchanger 28 wherein said liquid fuel is vaporized and discharged from the multiple chambers 27 into a second vaporizer manifold 30. In at least one embodiment this second vaporizer manifold 30 is formed into at least two chambers 30A and 30B. The respective chambers 30A and 30B are then connected to the respective vapor discharge pipes 13A or 13B for discharge of the vapor to the multiport valve 14. The multiport valve 14 is temperature activated in one embodiment and is of a standard design, which allows selective flow from either one or both vapor discharge pipes 13A and 13B into flow way 15 depending on the temperature of the vapor therein. The flowing of both vapor discharge pipes 13A and 13B through flow way 15 gives the maximum amount of vapor delivery to the vapor regulator 16. When one of the vapor discharge pipes 13A or 13B is closed off from flow by the multiport valve 14, the respective chamber either 30A or 30B builds up pressure which forces the liquid fuel out of that portion of the multiple chambers 27, which feeds the closed off chamber 30A or 30B to reduce the amount of liquid fuel exposed to the heated surfaces for vaporization. As there is only a very small amount of liquid fuel present in the liquid fuel vaporizer 10 no substantial back pressure is created when this pressure build up occurs. By the fuel being removed from the heated surfaces, the area of the heat exchanger 28 exposed to fluid is substantially reduced and the heat transfer is reduced to control the vaporization temperature. When the vapor temperature is low in flow way 15 the multiport valve 14 is opened to flow both discharge pipes 13A and 13B which allows more heat to be delivered by the heat exchanger 28.

The vapor regulator 16 of the system is connected in fluid communication with the flow way 15 for receiving the vaporized fuel. The vapor regulator 16 is in this embodiment, a two chamber body having a valve 20 communicating therebetween. A more specific description can be seen in FIG. 1 where the high pressure chamber 17 of the vapor regulator 16 is in fluid communication with flow way 15 to receive the vapor at relatively high pressure, thus the high pressure chamber 17 is the high pressure side of the vapor regulator 16.

In the high pressure chamber 17 there is provided a valve port 33 for discharging the vapor therefrom to the low pressure chamber 18. Located in the lowest most point in the high pressure chamber 17 is a valve port 34 and valve 23 for removing any liquid fuel which may have condensed and collected in the respective chambers. A fuel return line 24 is provided for delivering any liquid released from the high pressure chamber 17 and the low pressure chamber 18 back to the fuel tank 12.

In the low pressure chamber 18 which is the low pressure side, a valve 20 is provided for co-acting in setting relationship with valve port 33. The valve 20 is functionally connected to a diaphragm sensor 19 which senses and responds to varying changes in engine demand. Thus, when great demand is needed for vaporized fuel the diaphragm sensor 19 opens the valve 20 to flow vaporized fuel through valve port 33. In conditions of low or no demand the diaphragm sensor 19 closes down the valve 20 to limit or restrict the flow of vapor from the high pressure chamber 17. The bottom of the low pressure chamber 18 is provided a second valve port 39 and a valve 22 for removing any liquid fuel which may condense in the low pressure chamber 18 of the vapor regulator 16. The liquid fuel passed through valve 22 is discharged into fuel return line 24 for redelivering to the fuel tank 12. The vaporized fuel in the low pressure chamber 18 is passed out through discharge port 21 for delivery to the carburetor in response to engine demand for vaporized fuel.

Figure 2:
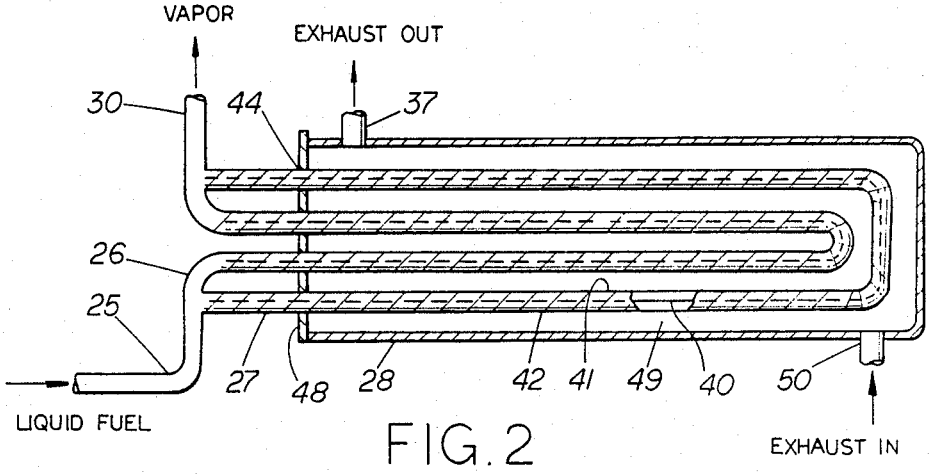
FIG. 2 is a cross-sectional view of the heat exchanger and the heat chamber of one embodiment of this invention.
Figure 3:
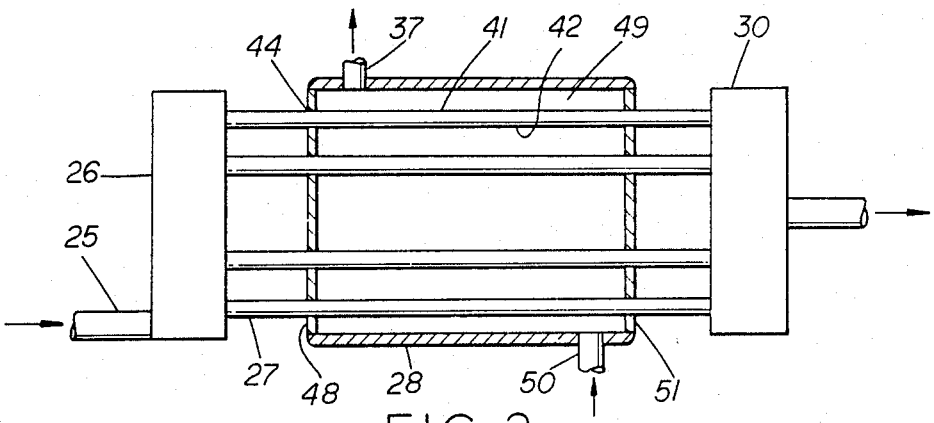
FIG. 3 is a cross-sectional view of the heat exchanger and includes the manifolds for input and output of the liquid and the vapor of this invention.
Figure 4:
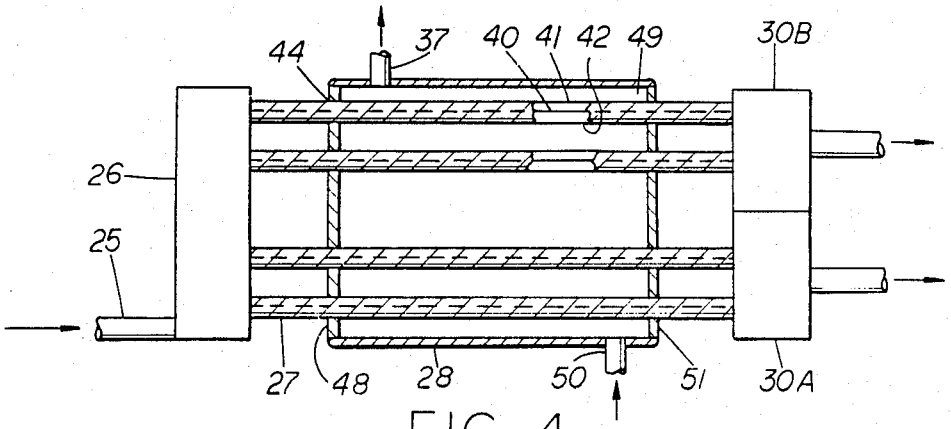
FIG. 4 is a cross-sectional view of the heat exchanger with the rod materials therein and manifolds for input and output of the liquid and vapor of this invention.
Figure 6:
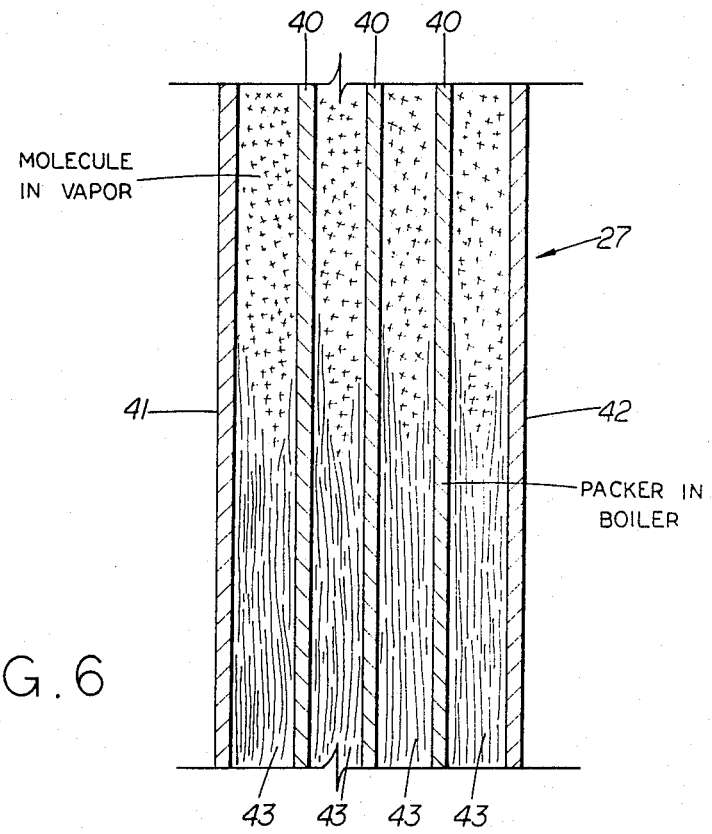
FIG. 6 is a cross-sectional view of a diagramatic drawing showing the liquid and vapor phase of the liquid fuel as it is spread over the surface of the multiple chamber.
Figure 5:
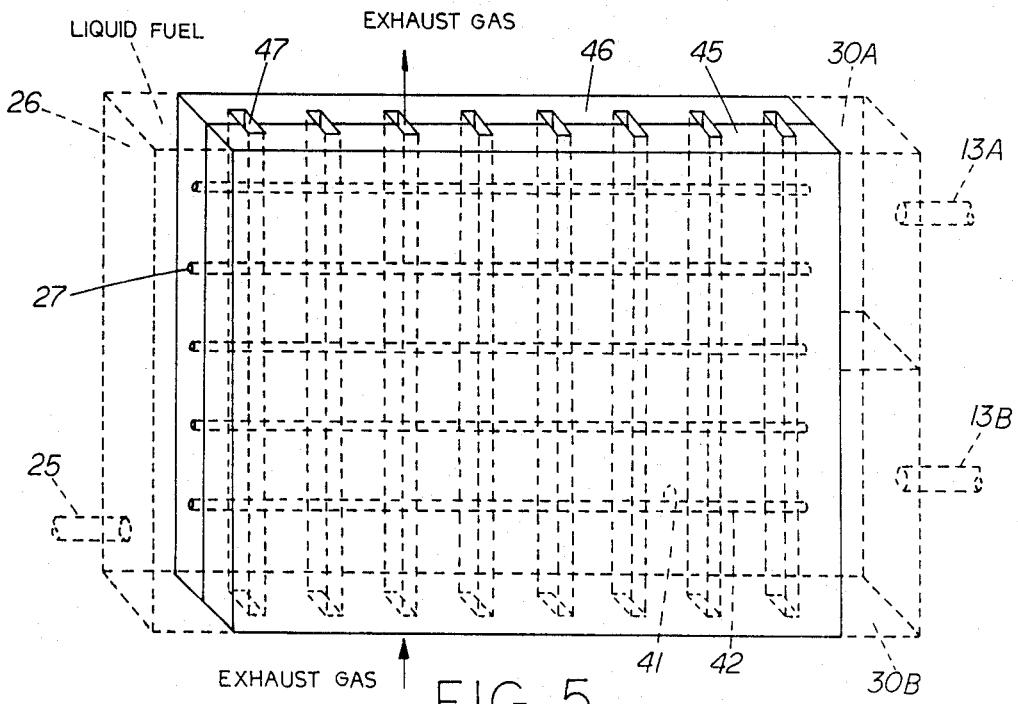
FIG. 5 is a hidden line view of yet another emodient of the heat exchanger of this invention and the manifolds thereof for input and output of the liquid and vapor.

It should be understood that the multiple chambers 27 in the liquid fuel vaporizer 10 are formed by having opposing surfaces 41 and 42 composed of inert material at least at the surfaces thereof for flowing liquid fuel therebetween. The opposing surfaces of the liquid fuel vaporizer 10 of this invention can be formed in many ways and still accomplish the results of this invention. For example, FIG. 5 and FIG. 6 show two different embodiments but in each case there are opposing surfaces 41 and 42 composed of inert material at least at the surfaces thereof with passages therebetween. In FIG. 2, FIG. 3 and FIG. 4 yet another form of providing the opposing surfaces 41 and 42 composed of inert material at least at the surfaces thereof are shown.

It should be further understood that the distances between the opposing surfaces 41 and 42 composed of inert material at least at the surfaces thereof, which form the passage therebetween will vary depending on the characteristics of the liquid fuel being vaporized. The passage must, however, be small but effective enough for the surface tension characteristics of the opposing surfaces 41 and 42 and the liquid fuel to spread the liquid fuel over the opposing surfaces 41 and 42. This passage space is thus so small that the fuel cannot form droplets of any significant size or bounce around, but they are squeezed into the space and the liquid is spread or smeared over the length of the opposing surfaces 41 and 42 composed of inert material at least at the surfaces thereof. Yet another criteria which should be realized as important is the length of the small but effective passages formed between the opposing surfaces 41 and 42 composed of inert material at least at the surfaces thereof, because depending on the type of liquid fuel and its characteristics such as surface tension, vapor pressure, boiling point, heat of vaporization, etc., the length should be such that the type of fuel would be completely vaporized before its exit from the passages between the opposing surfaces 41 and 42.

It should also be understood that the opposing surfaces 41 and 42 composed of inert material at least at the surfaces thereof can be made by chrome plating any good heat conductive material to provide the inert material at least at the surfaces thereof. Further, if costs are not a problem, stainless steel material may be used which will provide the inert material at least at the surface thereof, but also throughout and does not depart from the teaching of this invention. It has been discovered that unless inert material is provided at least at the opposing surfaces 41 and 42, that liquids such as alcohols begin to form carbon build-up which will block up the space between the opposing surfaces 41 and 42 and close off the system completely. It will be obvious to those skilled in the art that different inert materials may be required for different fluids used in the vaporizer 10 to provide inert material at least at the opposing surfaces 41 and 42. In the case of the group methanol, ethanol, propanol, iso-propanol and butanol, chromium or stainless steel will provide such an inert surface at least at the surfaces thereof.

In FIG. 6, which is an expanded diagramatic view of one multiple chamber 27 with opposing surfaces 41 and 42 for forming passages therebetween, the supposed theory which allows the invention to function is diagrammatically presented. Also, FIG. 6 has exhibited an additional materials 40 composed of inert material at least at the surface thereof, which can be such materials as twisted or packed wire placed between the opposing surfaces 41 and 42 to form yet additional opposing surfaces having inert material at least at the surfaces thereof. The creation of great opposing surface areas to interact with the surface tension of the liquid fuel can have its surface tension affected the greater the spreading effects, and the greater the heat transfer. In FIG. 6 the opposing surfaces 41 and 42 have additional materials 40 placed between the opposing surfaces 41 and 42 of the multiple chamber 27 to create the increased surface area with opposing surfaces 41 and 42 and 40 composed of inert material at least at the surfaces thereof in small but effective relationship. Thus, in FIG. 6 the liquid fuel 43 is spread over the inert opposing surfaces 41 and 42 and also additional inert materials 40 until it is vaporized. Keeping the liquid fuel close to the surfaces while in liquid phase without agitation and without the liquid forming bubbles or droplets provides for maximum heat transfer. If bubbles or droplets form, then some gas phase comes between the liquid and the heated surface with the loss of good heat transfer because the gas phase is less efficient than the liquid phase in heat transfer. Also, if the bubbles form in the gas phase with the resulting poor heat transfer, the liquid will not completely vaporize and will be carried by the high velocity gas stream through and out of the vaporizer.

Thus, in this invention, when the liquid fuel is from the group of methanol, ethanol, propanol, iso-propanol and butanol, the multiple chambers 27 have inert opposing surfaces 41 and 42 or 40 and 41 and additional inert materials 40 are positioned such that the small but effective passages formed therebetween are from 0.0005 of an inch to 0.05 of an inch. The exact inside dimension of these multiple chambers 27 can vary depending on the surface tension between the particular material of the inert opposing surfaces 41 and 42 and additional inert materials 40 and the liquid fuel.

The length of these passages formed between the inert opposing surfaces 41 and 42 and additional inert materials 40 can vary, but the length must be sufficient for the surface tension between the liquid fuel and the inert opposing surfaces 41 and 42 and additional inert materials 40 to keep the thin liquid relationship until the liquid fuel is vaporized. It should be understood that these conditions will vary depending on the heat of the boiler, atmospheric conditions, etc., but that an overall workable length can be established by allowing for the worst of conditions and designing the length accordingly.

Other embodiments of the liquid fuel vaporizer having opposing surfaces composed of inert material at least at the surfaces thereof for forming small but effective passages are shown in FIGS. 2, 3 and 5. In FIG. 5 the opposing surfaces 41 and 42 are formed by metal blocks 45 and 46 being drilled to form opposing surfaces 41 and 42. In this embodiment of FIG. 5 the heat exchanger 28 is also formed by passages 47 being drilled or cut in the block 45 to form the passages 47 for delivery of the hot exhaust gases which provide the heat required to vaporize the liquid fuel. It can be understood that any formation of opposing surfaces 41 and 42 and passages 47 may be used as long as the two do not communicate in fluid relationship with each other. The first vaporizer manifold 26 in FIG. 5 is shown in broken liens and would be positioned as shown. It should be noted that the liquid fuel is fed into the first vaporizer manifold 26 at the lowest point in the vaporizer manifold 26. This physical positioning of the liquid fuel inlet 25 at the lowest point allows for any excess in pressure which may build up to force the liquid fuel back against the fuel pump 11. Once the pressure exceeds the pressure of the fuel pump 11 all additional liquid would cease to flow into the first vaporizer manifold 26. Also by locating the liquid fuel inlet 25 at the bottom, no excess liquid could get trapped at the bottom and fed into the multiple chamber 27 even after the pressure may have stopped the delivery of additional liquid fuel.

The heat necessary to vaporize the liquid fuel in at least one embodiment as shown in FIG. 2 is supplied by the exhaust heat of the engine (not shown) being fed back to the heat exchanger 28 which has a heat chamber 49. The multiple chambers 27 are layed out through the heat chamber 49 by at least one end 48 of heat exchanger 28 having apertures 44 through which are passed the multiple chambers 27. The fit between the apertures 44 and the multiple chambers 27 need not be a sealed fit, but may be only a tight fit which becomes even tighter when one end 48 and the multiple chambers 27 are heated and expand. The heat is supplied by exhaust inlet 50 which causes the introduction of hot exhaust gases to enter the heat chamber 49. These gases are circulated in the heat chamber 49 and exhausted from an exhaust outlet 37.

In FIG. 3 however, a second end 51 is provided which is similar to one end 48 of the heat chamber 49 and the fits and function of this second end 51 is substantially the same as the one end 48. The one end 48 or the second end 51 may be attached in any conventional manner to the heat chamber 49 for securely holding the multiple chambers 27 in relatively fixed and separate positions within the heat chamber 49. The one end 48 and the second end 51 also provide a rapid means for removal of the multiple chambers 27 from the heat chamber 49 should any problems develop in the multiple chambers 27.

It should be understood that one advantage of having the first and second vaporizer manifold 26 and 30 outside of the heat chamber 49 is that the heat chamber 49 has corrosive gases therein and great thermal shocks from sudden introduction of hot gases therein, thus a significant improvement in the life expectancy of the liquid fuel vaporizer 10 occurs with this particular embodiment.

It will be understood that while specific forms of the invention have been described in order to make clear its general nature, the scope of the invention as set forth in the claims appendant hereto is not restricted to such specific forms, and in particular any other suitable form may be used in conformance with the claims to accomplish the objects of this invention.

What is claimed is:

1. A vaporizer for vaporizing liquid fuels having improved heat transfer and controls for vaporization of liquid fuels in response to varying degrees of fuel vapor demands comprising:

(a) a heat exchanger means formed from multiple chambers having opposing surfaces composed of inert material at least at said surfaces with small but effective passages formed therebetween and said opposing surfaces being in small but effective passage relationship of sufficient length for the surface tension between a liquid fuel and said opposing surfaces of said multiple chambers to spread the liquid fuel over said opposing surfaces of said multiple chambers for maintaining said liquid fuel in relatively constant and thin liquid relationship to said opposing surfaces of said multiple chambers of said heat exchanger until said liquid fuel is completely vaporized, before its exit therefrom, (b) a means for delivering liquid fuel to said heat exchanger means, (c) a means for delivering heat to said heat exchanger means for vaporizing said liquid fuel therein;

(d) a means for controlling the flow of vaporized liquid fuel from said vaporizer means, and (e) a means for controlling the flow of said liquid fuel to said heat exchanger means.

2. The vaporizer of claim 1 wherein said heat exchanger means formed from said multiple chambers having opposing surfaces composed of inert material at least at said surfaces further comprises additional means composed of inert material at least at said surfaces thereof placed between said opposing surfaces of said multiple chambers for forming multiple small but effective passages therebetween.

3. The vaporizer of claim 2 wherein said additional means placed between said opposing surfaces composed of inert material at least at said surfaces of said multiple chambers for forming additional multiple small but effective passages therebetween comprises wire means having inert surfaces.

4. The vaporizer of claim 3 wherein said wire means composed of inert material at least at the surface thereof is twisted to further increase the surface area for acting with the surface tension of said liquid fuel.

5. The vaporizer of claim 4 wherein said wire means composed of inert material at least at the surface thereof is stainless steel material.

6. The vaporizer of claim 4 wherein said wire means composed of inert material at least at the surface thereof is chromium-plated wire.

7. The vaporizer of claim 2 wherein said additional means placed between said opposing surfaces of said multiple chambers for forming additional multiple small but effective passages therebetween comprises a plurality of small, solid particular material composed of inert material at least at the surface thereof arranged in such a manner as to form passages therebetween.

8. The vaporizer of claim 2 wherein said heat exchanger means formed from said multiple chambers having opposing surfaces with small but effective passages formed therebetween further comprises multiple chambers having passages of 0.0005 of an inch to 0.05 of an inch between said opposing surfaces and said passages being of sufficient length for the surface tension between a liquid fuel from the group methanol, ethanol, propanol, iso-proponal and butanol and said opposing surfaces in said multiple chambers to keep said liquid fuel from said group in relatively constant and thin liquid relationship to said opposing surfaces of said multiple chambers of said heat exchanger until vaporized.

9. The vaporizer of claim 8 wherein said means for delivering liquid fuel to said heat exchanger means further comprising:

(a) a fuel tank, (b) a fuel pump for pumping the liquid fuel from said fuel tank at a relatively constant pressure, and (c) a first vaporizer manifold means connected in fluid communications with said fuel pump and said vaporizer means for spreading pressure ariation from said vaporizer evenly in said liquid fuel in said first vaporizer manifold prior to delivering said liquid.

10. The vaporizer of claim 9 wherein said means for controlling the flow of said vaporized liquid fuel from said vaporizer means comprising:

(a) a second vaporizer manifold means connected in fluid communication with said vaporizer means having at least two chambers, a valve mean connected in fluid communication with said chambers of said second vaporizer manifold means for selectively flowing one or both of said chambers in response to the vapor demand.

11. The vaporizer of claim 8 further comprising a vapor regulator in fluid communication with said vaporizer having a first vapor chamber for receiving vaporized fuel and a second vapor chamber in fluid communication with said first vapor chamber and the discharge side of said vapor regulator.

12. The vaporizer of claim 11 wherein said first vapor chamber has a valve for removal of liquid fuel which may collect and said valve is located at the lowest point in first vapor chamber.

13. The vaporizer of claim 12 wherein said second vapor chamber has a valve for removal of liquid fuel which may collect and said valve for removal of liquid fuel which may collect and said valve is located at the lowest point in said vapor chamber.

14. The vaporizer of claim 12 wherein said means for delivering heat to said heat exchanger comprises a heat chamber in fluid communication with said means for delivering heat and substantially surrounding said heat exchanger.

15. The vaporizer of claim 12 wherein said heat chamber further comprises a tubular member for receiving said heat exchanger means therein and at least one cover means for receiving said heat exchanger means therethrough in substantially close relationship to apertures formed in the cover means and said cover means is fastened to said tubular means.

16. A vaporizer for vaporizing liquid fuels having improved heat transfer and controls for vaporization of liquid fuels in response to varying degrees of fuel vapor demands comprising:

(a) a heat exchanger means formed from multiple chambers having opposing surfaces composed of inert material at least at said surfaces with small but effective passages formed therebetween having passages of 0.0005 of an inch to 0.05 of an inch between said opposing surfaces and said opposing surfaces being in said small but effective passage relationship for sufficient length for the surface tension between a liquid fuel from the group methanol, ethanol, propanol, iso-propanol and butanol and said opposing surfaces of said multiple chambers to spread the liquid fuel over said opposing surfaces of said multiple chambers for maintaining said liquid fuel in relatively constant and thin liquid relationship to said opposing surfaces of said multiple chambers of said heat exchanger until said liquid fuel is vaporized, (b) a means for delivering liquid fuel to said heat exchanger means, (c) a means for delivering heat to said heat exchanger means for vaporizing said liquid fuel therein;

(d) a means for controlling the flow of vaporized liquid fuel from said vaporizer means, and (e) a means for controlling the flow of said liquid fuel to said heat exchanger means.

17. The vaporizer of claim 16 wherein said heat exchanger means formed from said multiple chambers having opposing surfaces composed of inert material at least at said surfaces further comprises additional means composed of inert material at least at said surfaces thereof placed between said opposing surfaces of said multiple chambers for forming multiple small but effective passages therebetween.

18. The vaporizer of claim 17 wherein said additional means placed between said opposing surfaces composed of inert material at least at said surfaces of said multiple chambers for forming additional multiple small but effective passages therebetween comprises wire means having inert surfaces.

19. The vaporizer of claim 18 wherein said wire means composed of inert material at least at the surface thereof is twisted to further increase the surface area for acting with the surface tension of said liquid fuel.

20. The vaporizer of claim 19 wherein said wire means composed of inert material at least at the surface thereof is stainless steel material.

21. The vaporizer of claim 19 wherein said wire means composed of inert material at least at the surface thereof is chromium-plated wire.

22. The vaporizer of claim 17 wherein said additional means placed between said opposing surfaces of said multiple chambers for forming additional multiple small but effective passages therebetween comprises a plurality of small, solid particular material composed of inert material at least at the surface thereof arranged in such a manner as to form passages therebetween.

23. The vaporizer of claim 17 wherein said means for delivering liquid fuel to said heat exchanger means further comprising:

(a) a fuel tank, (b) a fuel pump for pumping the liquid fuel from said fuel tank at a relatively constant pressure, and (c) a first vaporizer manifold means connected in fluid communications with said fuel pump and said vaporizer means for spreading pressure ariation from said vaporizer evenly in said liquid fuel in said first vaporizer manifold prior to delivering said liquid.

24. The vaporizer of claim 23 wherein said means for controlling the flow of said vaporized liquid fuel from said vaporizer means comprising:

(a) a second vaporizer manifold means connected in fluid communication with said vaporizer means having at least two chambers, a valve mean connected in fluid communication with said chambers of said second vaporizer manifold means for selectively flowing one or both of said chambers in response to the vapor demand.

25. The vaporizer of claim 17 further comprising a vapor regulator in fluid communication with said vaporizer having a first vapor chamber for receiving vaporized fuel and a second vapor chamber in fluid communication with said first vapor chamber and the discharge side of said vapor regulator.

26. The vaporizer of claim 25 wherein said first vapor chamber has a valve for removal of liquid fuel which may collect and said valve is located at the lowest point in first vapor chamber.

27. The vaporizer of claim 26 wherein said second vapor chamber has a valve for removal of liquid fuel which may collect and said valve for removal of liquid fuel which may collect and said valve is located at the lowest point in said vapor chamber.

28. The vaporizer of claim 26 wherein said means for delivering heat to said heat exchanger comprises a heat chamber in fluid communication with said means for delivering heat and substantially surrounding said heat exchanger.

29. The vaporizer of claim 26 wherein said heat chamber further comprises a tubular member for receiving said heat exchanger means therein and at least one cover means for receiving said heat exchanger means therethrough in substantially close relationship to apertures formed in the cover means and said cover means is fastened to said tubular means.

* * * * *